US007131570B2

(12) United States Patent
Quaintance

(10) Patent No.: US 7,131,570 B2
(45) Date of Patent: Nov. 7, 2006

(54) SELF-LOCKING ROLL-OVER FLAP WITH HOOK LOCK

(75) Inventor: Benjamin Quaintance, Germantown, TN (US)

(73) Assignee: International Paper Company, Memphis, TN (US)

( * ) Notice: Subject to any disclaimer, the term of this patent is extended or adjusted under 35 U.S.C. 154(b) by 116 days.

(21) Appl. No.: 10/712,929

(22) Filed: Nov. 12, 2003

(65) Prior Publication Data

US 2005/0017061 A1 Jan. 27, 2005

Related U.S. Application Data

(60) Provisional application No. 60/425,619, filed on Nov. 12, 2002.

(51) Int. Cl.
*B65D 5/20* (2006.01)
*B65D 43/08* (2006.01)
*B65D 5/56* (2006.01)

(52) U.S. Cl. ..... 229/125.28; 229/177; 229/178; 229/179

(58) Field of Classification Search ..... 229/125.19, 229/125.28, 177, 178, 179
See application file for complete search history.

(56) References Cited

U.S. PATENT DOCUMENTS 1,218,353 A * 3/1917 Bachmann ..... 229/177
2,039,315 A * 5/1936 Heineman ..... 229/177
2,357,155 A * 8/1944 Williams et al. ..... 229/125.28
3,273,779 A * 9/1966 Mykleby ..... 229/178
3,369,728 A * 2/1968 Royce ..... 229/125.28
3,616,989 A * 11/1971 Martinek et al. ..... 229/125.19
4,046,309 A * 9/1977 Poggiali ..... 229/125.28

(Continued)

FOREIGN PATENT DOCUMENTS

FR 2144619 2/1973

*Primary Examiner*—Gary Elkins
(74) *Attorney, Agent, or Firm*—Thomas W. Barnes, III; Daniel C. Stelter; Dennis H. Lambert

(57) ABSTRACT

A corrugated paperboard container (10) has a bottom (11), opposite side walls (12, 13) and opposite end walls (14, 15). The end walls include an end panel (18) that is foldably connected to the bottom, and end flap panels (16, 17) that are foldably connected to the side walls. A roll-over flap (23) is connected to the end wall by a web (24), and a notch (20) is in the top edge of the end flap panels. The end wall panel and end flap panels are folded into overlying relationship, and the roll-over flap is folded over an upper edge of the end wall panel, with the web lying in the notch. A projection or hook (41) extends into one side of the notch to engage an edge of the web to retain the web in the notch. A blank for making the container is also disclosed. A cover (50, 70) for the container, and a blank for making the same, include an end wall panel (54, 75) and end flap panels (57, 58), with a roll-over flap (23, 76) connected to the end wall panel, and a hook (41) to engage an edge of the web joining the roll-over flap to an end panel of the cover. In one embodiment of a cover, crushed areas (61, 62) are formed in the cover to provide a depression for receiving an edge of the end flap panels, and in another embodiment, a cover lock tab (73) extends downwardly from the end walls of the cover for engagement in hand hold openings (80) in the ends of a container.

7 Claims, 11 Drawing Sheets

U.S. PATENT DOCUMENTS 4,139,146 A * 2/1979 Bamburg et al. ..... 229/194
4,676,429 A 6/1987 Crowe et al.
5,752,648 A 5/1998 Quaintance
6,158,652 A 12/2000 Ruiz et al.
6,179,204 B1 * 1/2001 Blower et al. ..... 229/178
2003/0047592 A1 3/2003 Quaintance

* cited by examiner

SELF-LOCKING ROLL-OVER FLAP WITH HOOK LOCK

RELATED APPLICATIONS

This application claims priority of Provisional Application 60/425,619 filed Nov. 12, 2002.

TECHNICAL FIELD

This invention relates to packaging. More specifically, the invention relates to a multi-sided container or box made of corrugated paperboard. In particular, the invention relates to a corrugated paperboard tray for containing poultry products, wherein the tray is configured for manual set up and has an improved self-locking feature for retaining the walls of the tray in erected position.

BACKGROUND ART

Various styles of containers, including paperboard boxes, are known in the prior art for containing a variety of products. Cut poultry pieces, for example, are frequently packed in a paperboard container, and sometimes the poultry pieces are packed with ice. These containers are generally referred to as poultry trays, and are usually made from a unitary blank of corrugated paperboard, which may be treated on one or both sides with wax or other material to impart rigidity and resistance to water degradation.

Conventional paperboard containers are configured for either machine set up or manual set up, and generally are either rectangular or octagonal in plan view, with four sides or eight sides, respectively. An example of a prior art eight-sided container is disclosed in applicant=s prior patent U.S. Pat. No. 5,752,648. The embodiment shown in FIGS. 1 and 3 of that patent is configured for manual set up, and has three overlapping end panels 18, 24 and 24, with notches 30 formed in the top edges of the two end panels 24, and a roll-over flap 34 foldably joined to the top edge of end panel 18 by short narrow webs formed between transverse cuts or relief slits 37 extending in spaced relationship transversely across cut lines 36 and 38, and interrupting the cut lines. Pairs of short cuts or slits 39 are formed in the webs parallel to the cut lines 36 and 38, but spaced from one another on opposite sides of the cut lines a distance approximately equal to the combined thickness of the three overlapped end panels. The slits 39 promote bending or folding of the webs along fold lines extending through the slits.

To erect the container, the two end panels 24 are folded inwardly into overlapping registry with one another, and the end panel 18 is then folded into overlapping relationship with panels 24. The roll-over flap 34 is then folded inwardly and downwardly over the upper edges of the panels 24, causing the webs to drop into notches 30, and the upwardly extending portions of panels 24 on opposite sides of the notches to project upwardly through the cuts formed by the cut lines 36 and 38. The relationship of the relief slits 37 and cut lines 36 and 38 causes a "heel" to be formed on the edge of the roll-over flap, and this heel produces an over-center effect when the roll-over flap is folded over the panels 24. The heel engages against the inner surface of the innermost end panel 24 to keep the roll-over flap in its folded position, and thereby maintains the container in erected condition.

While the arrangement disclosed in U.S. Pat. No. 5,752,648 provides a simple and effective self-locking system for holding the container in its erected condition, the thickness of the material of the webs causes them to take a slightly "rounded over" shape as they are pulled down into the notches 30, and they tend to exert a pull on the roll-over flap in a direction to disengage it. Additionally, in order to insure that the webs and related components can be operatively engaged with one another, specific dimensional relationships are maintained between the distance from the bottoms of the notches to the bottom of their associated panels 24, and the distance which the relief slits 37 extend above the cut lines 36 and 38, i.e., the length of the relief slits is slightly exaggerated, contributing to a "loose" fit between the components of the self-locking arrangement.

A solution to this was offered in applicant's co-pending patent application, published Mar. 13, 2003, under publication number US-2003-0047592-A1. The container disclosed in this application is similar to that used in U.S. Pat. No. 5,752,648, but is modified to achieve a tighter fit between components of the self-locking arrangement and provide a more reliable interlocking of the components. More specifically, the container disclosed in US-2003-0047592-A1 has a bottom wall, opposite side walls, and opposite end walls, with means on the end walls that interlock to hold the container in its erected condition. The container is made from a unitary corrugated paperboard blank having a bottom panel that forms the bottom wall, opposite side wall panels foldably joined to opposite sides of the bottom panel and that form the side walls, and end panels extending from opposite ends of the bottom panel and side wall panels, respectively, at least some of the end panels overlapping to form the end walls. At least one notch is formed on an upper edge of at least one of the end panels, and a roll-over flap is formed on an upper edge of another end panel, in positions to interlock with one another when the end panels are folded into operative relationship with one another to form an erected container.

In particular, the self-locking structure in US-2003-0047592-A1 has a plurality of notches formed in the edge of at least one end panel, defining at least one tab projecting upwardly from the edge of the panel, and the roll-over flap is foldably joined to its associated end panel by webs formed between a cut line that lies parallel to the fold for the roll-over flap, and relief slits that extend transversely across the cut line. The webs are adapted to lie in the notches, with said at least one tab projecting into a slot formed by the cut line when the roll-over flap is folded inwardly and downwardly over the end panels. The webs are at least partially crushed on the side thereof that faces downwardly in the notches so that they lie substantially flat in the notches. In addition, the dimensional relationships of the self-locking arrangement are made tighter to effect a tighter fit between components, producing a more reliable interlock. Specifically, the distance from the bottom of the notches to the bottom of their associated panels is made smaller than in a tray having a conventional self-locking arrangement, and the length of the relief slits is also made smaller.

However, the prior self-locking roll-over flap as disclosed in the co-pending patent application identified above, and as illustrated in FIGS. 1 and 2 attached hereto, may come unlocked under stress, e.g., when force is exerted against the side walls by product in the container, causing the package to partially disassemble.

Accordingly, there is need for a self-locking arrangement that provides a tight, secure fit between components, and that does not come unlocked under stress, insuring that a container incorporating the arrangement reliably remains in its erected condition.

SUMMARY OF THE INVENTION

The invention is a paperboard container of the type having a self-locking roll-over flap on at least one wall, wherein the roll-over flap is foldably joined to an outer wall panel by a roll-over panel. The top edge of the roll-over panel has an extended heel portion that abuts against an adjacent end panel top edge to hold the roll-over panel in position. In particular, according to the present invention, a "hook" or shaped recess is formed in the edge of one or more of the tabs formed on the end panel top edges to engage an edge of the roll-over panel and act as a positive detent against the edge of the roll-over panel and prevent it from opening.

More specifically, the container of the invention has a bottom wall, opposite side walls, and opposite end walls, with means on the end walls that interlock to hold the container in its erected condition. The container is made from a unitary corrugated paperboard blank having a bottom panel that forms the bottom wall, opposite side wall panels foldably joined to opposite sides of the bottom panel and that form the side walls, end flap panels extending from opposite ends of the side wall panels, and end wall panels extending from opposite ends of the bottom panel, at least some of the end panels overlapping to form the end walls in accordance with the invention. At least one notch is formed on an upper edge of at least one of the end flap panels, and a roll-over flap is formed on an upper edge of the end wall panel, in positions to interlock with one another when the end panels are folded into operative relationship with one another to form an erected container.

In particular, a plurality of notches are formed in the edge of at least one end flap panel, defining at least one tab projecting upwardly from the edge of the panel, and the roll-over flap is foldably joined to its associated end wall panel by webs formed between a cut line that lies parallel to the fold for the roll-over flap, and relief slits that extend transversely across the cut line. The webs are adapted to lie in the notches, with said at least one tab projecting into a slot formed by the cut line when the roll-over flap is folded inwardly and downwardly over the end panels.

The webs may be crushed on the side thereof that faces downwardly in the notches so that they lie substantially flat in the notches. In addition, the dimensional relationships of the self-locking arrangement are made tighter to affect a tighter fit between components, producing a more reliable interlock. Specifically, the distance from the bottom of the notches to the bottom of their associated panels is made smaller than in a tray having a conventional self-locking arrangement, and the length of the relief slits is also made smaller.

The "hook" or shaped recess noted above, and which represents an improvement over the invention disclosed in co-pending published application US-2003-0047592-A1, is formed in the edge of one or more of the tabs formed on the end flap panel top edges to act as a positive detent against the edge of the roll-over panel and prevent it from opening under stress.

A further aspect of the container disclosed and claimed herein is a crushed area formed in the top panel of the container cover adjacent the fold joining the end panel of the cover to the top panel. This crushed area provides a relief space for the inwardly folded end flaps that are connected to the side panels of the cover, and captured by the roll-over flap or panel in an erected cover, enabling a more accurate fit of the cover and avoiding bowing of the sides when the cover is folded into erected condition. This feature is particularly useful when the slit in the cover blank that separates the end flaps from the end panel is made in axial alignment with the score line that joins the side panel to the top panel, since in this configuration there is a very tight fit between the panels when folded. Additionally, the material along each side of the slit is crushed to provide adequate space to enable the panels to be folded together.

A still further aspect of the container disclosed and claimed herein resides in a cover having locking features like those described above for the box, and further having a locking tab that projects downwardly from the end walls of the cover and which engage in the handholds in the ends of the box when the cover is in place to help retain the cover on the box. In the present invention the locking tab has a lower free end with a downwardly and outwardly directed rounded wing on each of the opposite sides of the free end. The end of the tab between the wings has an arcuate, concave shape. In use, the wings and arcuate end on the tab facilitate flexing of the end of the tab through the handholds, and the concave arcuate shape facilitates insertion of a finger or fingers behind the end of the tab to retract the tab from the handhold.

The invention is a simple, economical and effective way to reliably interlock components of a self-locking arrangement in a container constructed for manual set up. It adds no cost to the container.

BRIEF DESCRIPTION OF THE DRAWINGS

The invention is described in greater detail hereinafter with reference to the drawings, wherein like reference characters designate like parts throughout the several views, and wherein.

DETAILED DESCRIPTION OF THE PREFERRED EMBODIMENTS

Figure 1:
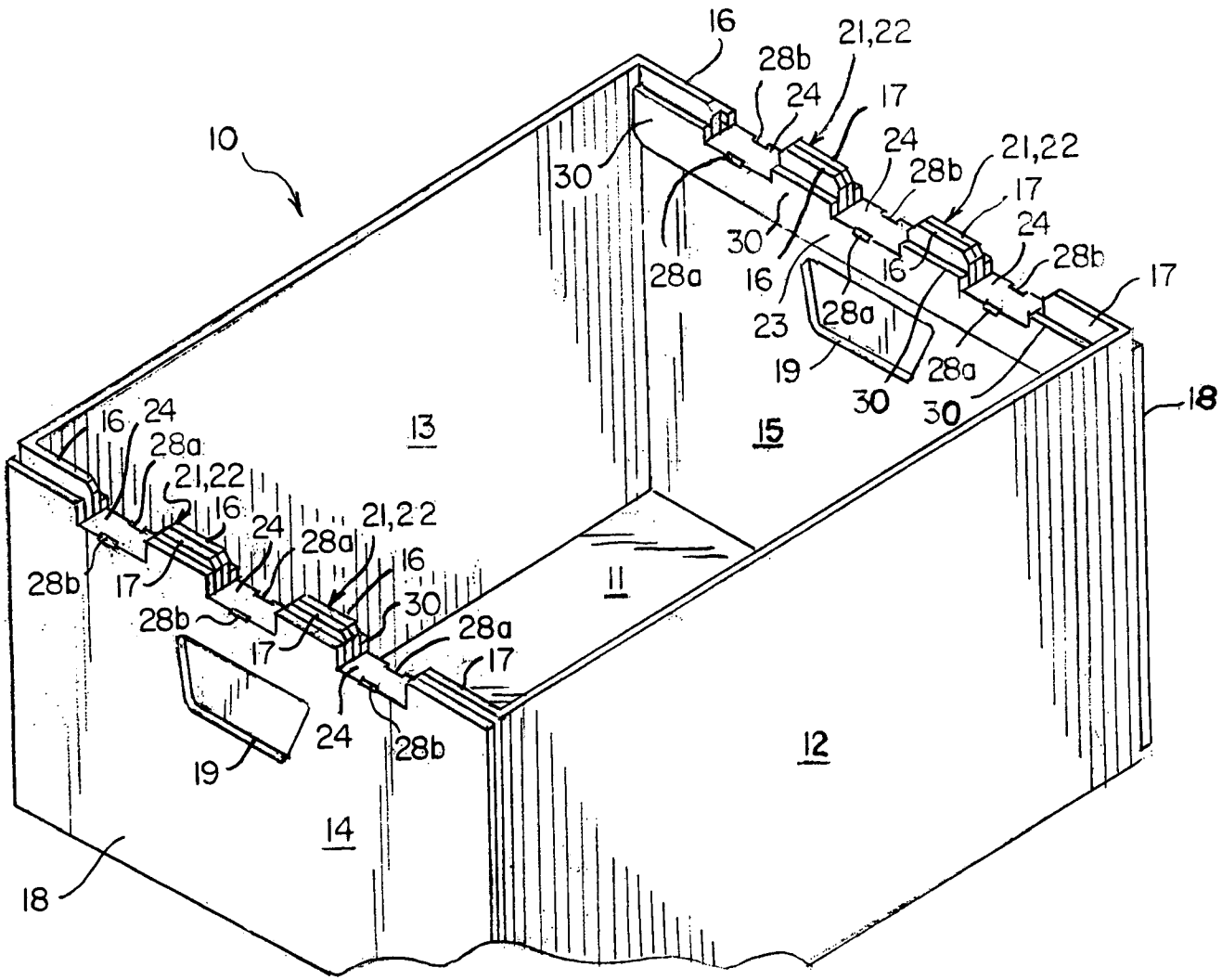
FIG. 1 is a top perspective view of a four-sided rectangular container as disclosed and claimed in applicant's co-pending published application, number US-2003-0047592-A1, and is of the type in which the present invention can be employed.

A rectangular or four-sided container incorporating the self-locking means disclosed in co-pending published application number US-2003-0047592-A1 is depicted at 10 in FIG. 1. The structure of this container is the same as the structure incorporating the present improvement, and except for the hook feature to be described hereinafter, the following description applies equally as well to the container incorporating the present improvement.

Figure 4:
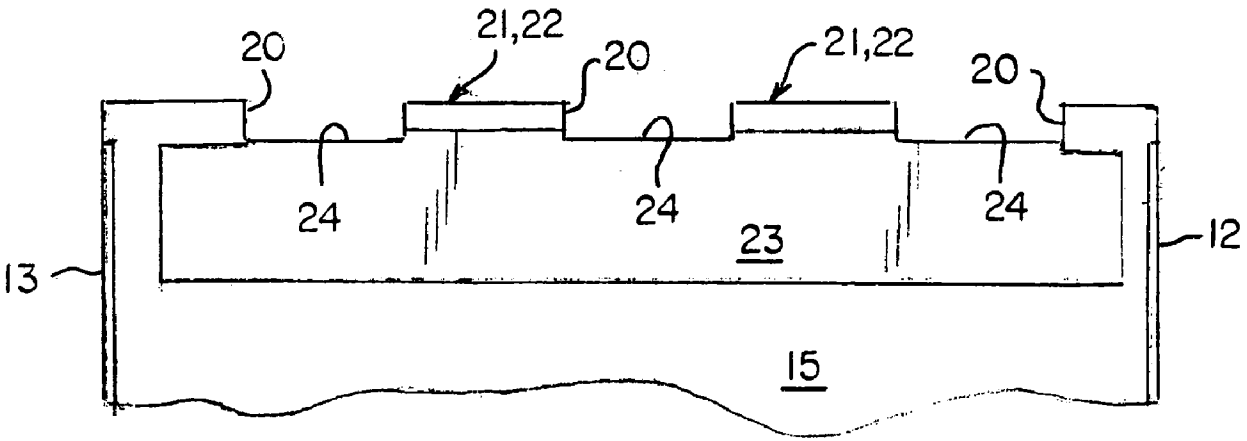
FIG. 4 is an enlarged fragmentary inside end view of the container of FIG. 1, showing in greater detail the locking features of the self-locking roll-over flap.
Figure 5:
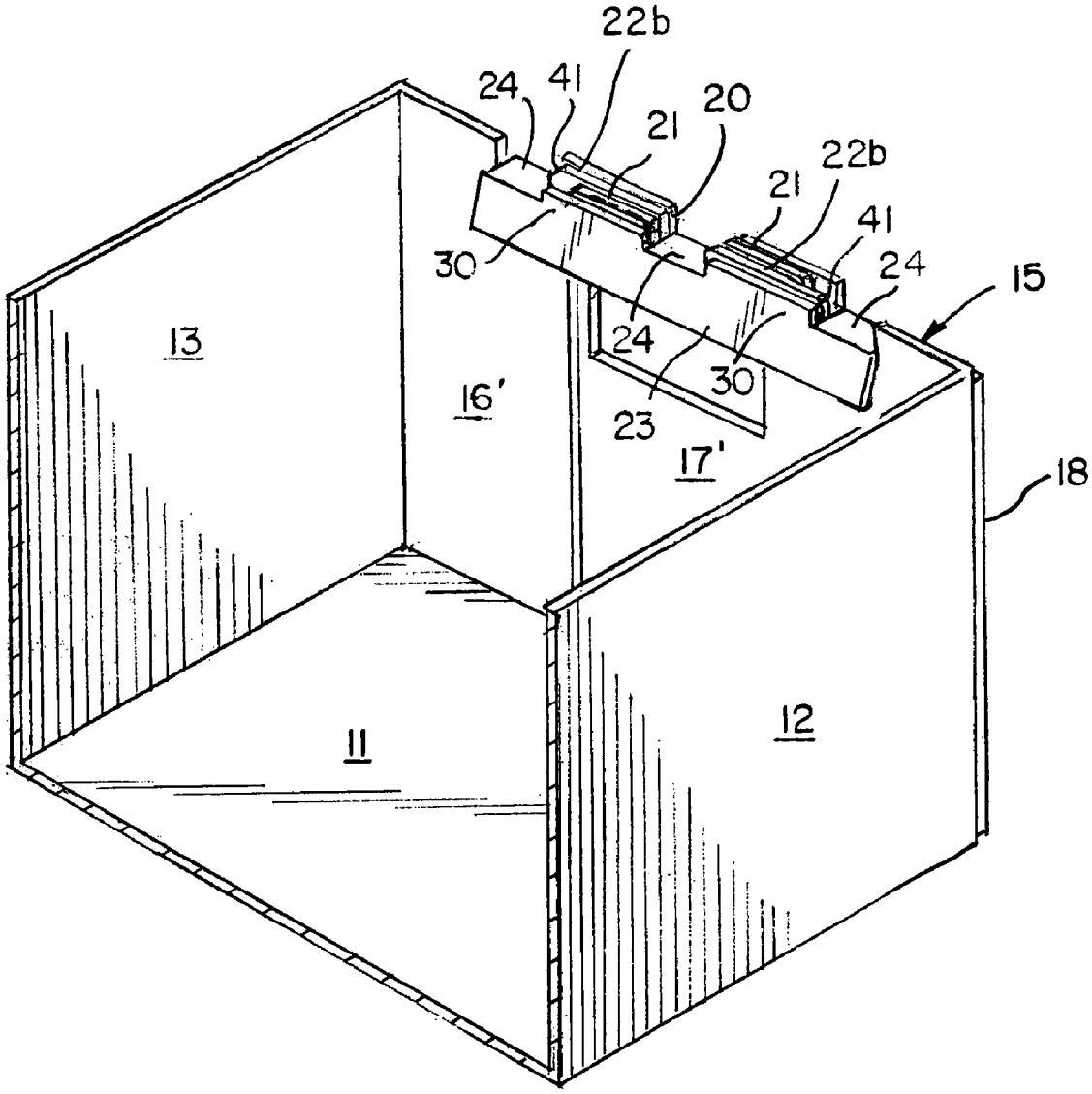
FIG. 5 is a fragmentary top perspective view of one end of a four-sided container incorporating the improvements of the present invention.

The container 10 comprises a bottom wall 11, opposite parallel side walls 12 and 13, and opposite parallel end walls 14 and 15. Each end wall comprises two end panel flaps 16 and 17 foldably joined to opposite ends of respective side walls, and an end wall panel 18 foldably joined to the end of the bottom wall. In this regard, it should be understood that the end flaps each can extend the full width of the end wall, or only partially. FIGS. 4 and 5, for instance, depict an arrangement wherein the end flaps each extend only approximately two-thirds the width of the end all. Cuts 19 are made in the end flap panels 16 and 17 and in the end wall panels 18 to define handholds when the container is erected.

A plurality of notches 20 are formed in each end flap panel 16 and 17 along an outer edge, which becomes the upper edge when the container is set up, forming a pair of upwardly projecting tabs 21 and 22.

A roll over flap 23 is joined to the outer, or upper, edge of end wall panel 18 by a plurality of webs 24 defined by cuts or relief slits 25 and 26 made transversely across a cut line 27, and interrupting the cut line, which extends completely across the width of panel 18 except at the webs 24. Short fold promoting slits 28*a* and 28*b* are made parallel to the cut line 27 on opposite sides thereof in locations to define the length of the webs when the roll-over flap is folded into its operative, locked position. In other words, the slits 28*a* and 28*b* initiate folding at opposite ends of the web along fold lines extending through the slits. The length of the webs, as defined by the spacing between the slits, and thus between the fold lines extending through them, is substantially the same as the combined thickness of the total number of overlapping end panels.

Figure 2:
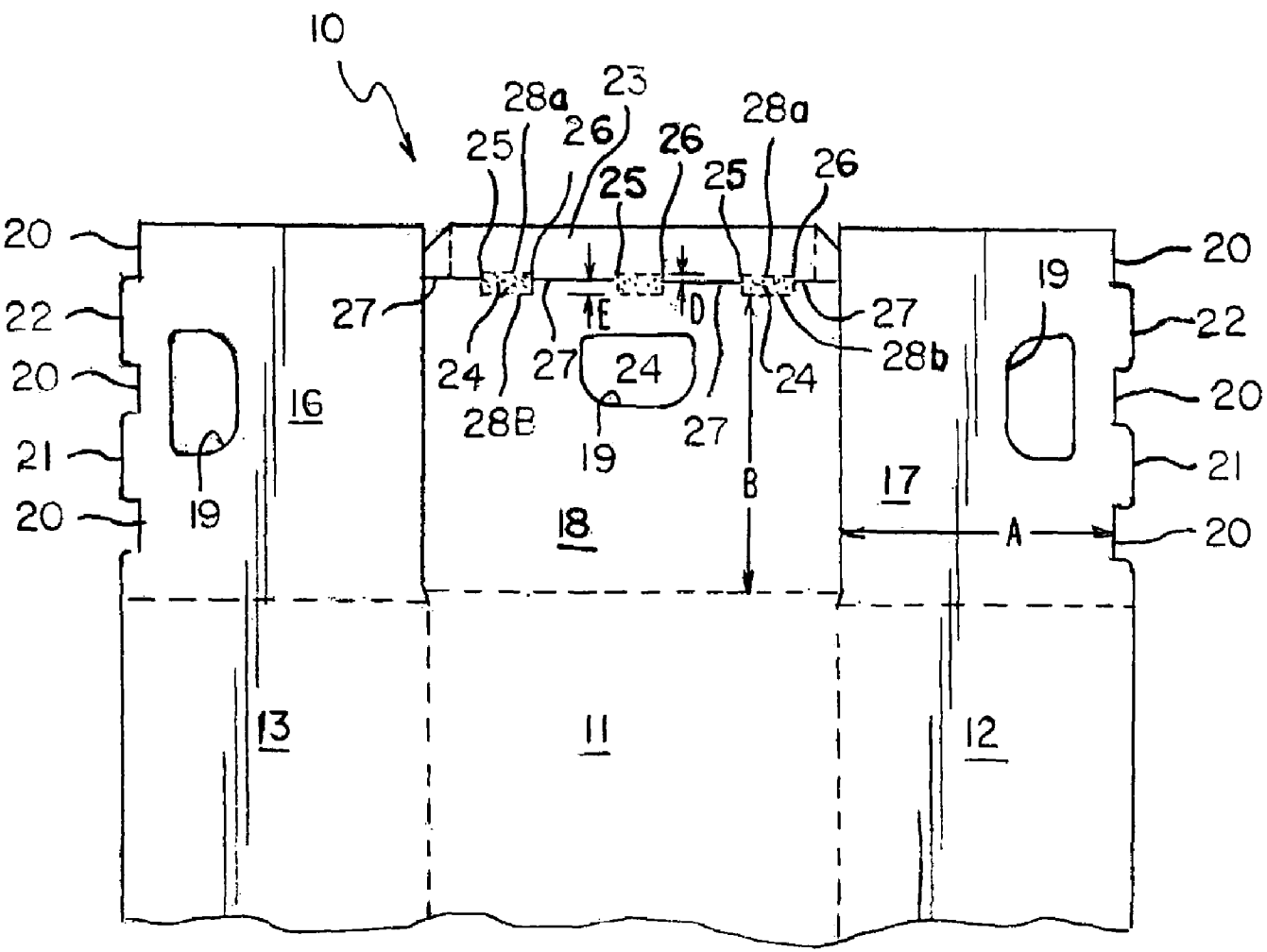
FIG. 2 is an enlarged plan view of one end of the blank for forming the container of FIG. 1.
Figure 3:
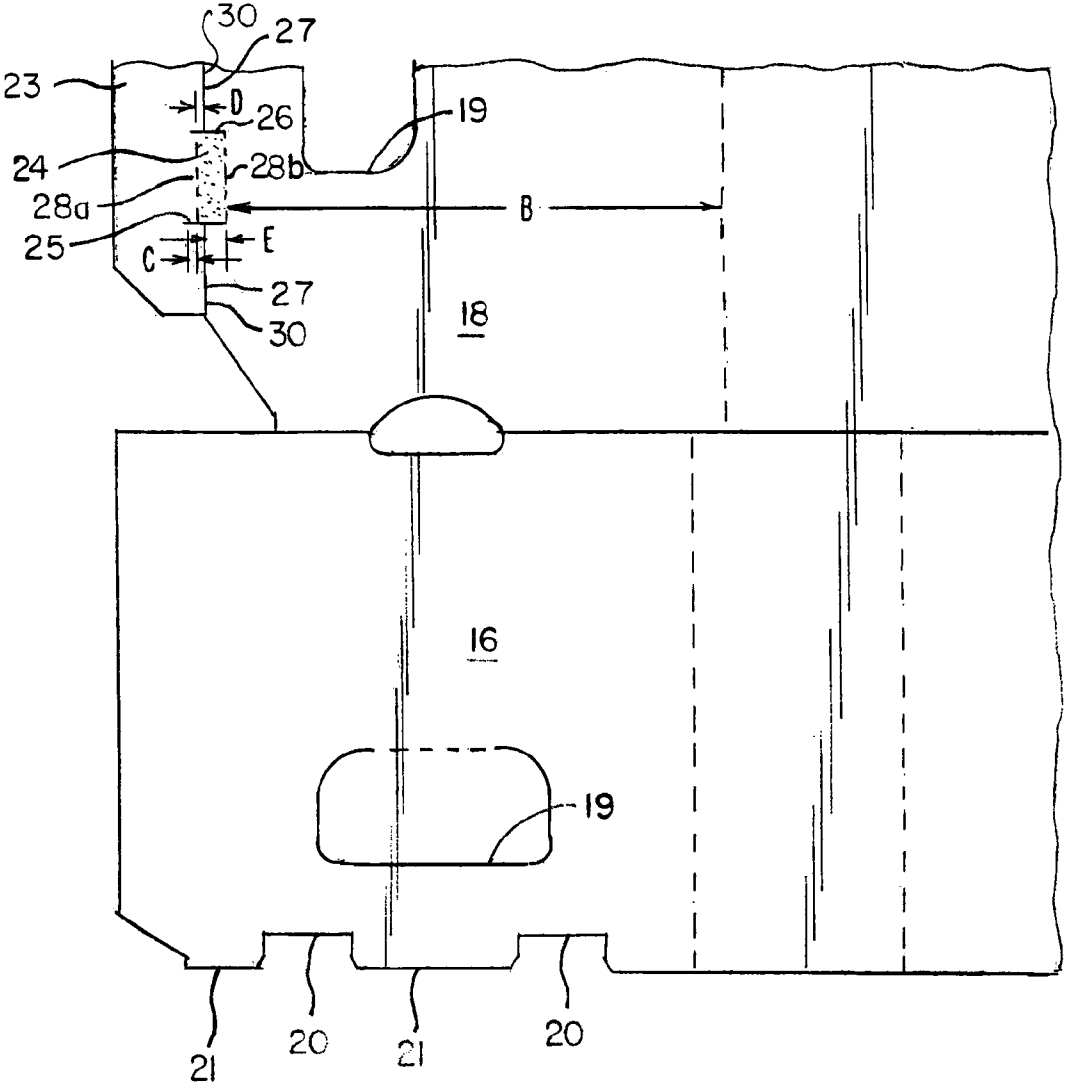
FIG. 3 is a further enlarged fragmentary plan view showing further details of one corner of a container incorporating the invention, and differing from the arrangement shown in FIG. 2 in that the roll-over flaps do not extend all the way across the width of the end wall, the corners of the end flaps are angled, cut-outs are made in the slit separating the end flaps from the end panels, and diagonal corner panels are provided.

As indicated by the shading in FIGS. 2 and 3, the web 24 is crushed in the area between the cuts 25, 26 and fold promoting slits 28. The crush is made on the side of the web that faces inwardly of the container when the container is set up. Crushing of the web enables the web to extend more deeply into the notches, and provides a sharper fold along the fold lines promoted by the slits 28*a* and 28*b*. It also enables other dimensions of the container to be tightened up, as described more fully below, developing a tighter and more reliable self-locking arrangement. It should be noted that while FIG. 3 is used to show the details of construction of the self-locking arrangement, and reference characters applicable to FIGS. 1 and 2 are used, FIG. 3 actually portrays a portion of a blank designed for making the eight-sided container of FIG. 15.

To erect the container, the side walls 12 and 13 are folded upwardly, and the end flap panels 16 and 17 then folded inwardly into overlapping relationship with one another. As seen in the drawings, panel 17 is folded inwardly first, although the sequence of folding the two end flap panels is not essential. As folded, the notches 20 and tabs 21 and 22 on the two end flap panels are in registry with one another. The end wall panel 18 is then folded upwardly over the panels 16 and 17, and roll over flap 23 is folded inwardly and downwardly over the upper edge of the end flap panels and end wall panels, causing the webs 24 to drop into the notches and the tabs 21 and 22 to project upwardly through the gap formed by the cut line 27. Because of the spacing of the cuts 25, 26, 27 and 28*a* and 28*b*, a "heel" 30 is formed on the roll-over panel in the areas on opposite sides of the webs, and this heel engages against the inner surface of end flap panel 17, holding the roll-over flap in its downwardly folded and locked position inside the panel 17.

The dimensional relationships of the self-locking structure can best be seen with particular reference to FIGS. 1, 2 and 3. The spacing "A" between the bottom of the notches 20 and the bottom edge of the associated end flap panel 16 or 17 is increased slightly over the spacing in the prior self-locking arrangement shown in U.S. Pat. No. 5,752,648, and the spacing "B" between the bottom edge of end wall panel 18 and the closest slit 28*b* is reduced slightly from the spacing in the prior self-locking arrangement. The spacing between the slits 28*a* and 28*b*, as noted previously, is selected to be substantially the same as the combined width of the total number of overlapping end panels. It will be noted that the slits 25 and 26 extend slightly beyond slit 28*a* a distance "C", defining relief slits for the folded roll over flap. Slit 28*a* is spaced from cut line 27 a distance "D" approximately equal to a thickness of one of the end panels, and slit 28*b* is spaced on the opposite side a distance "E" approximately equal to the combined thickness of the total number of overlapping end panels, minus the thickness of one panel.

When the roll-over flap 23 is folded downwardly alongside panel 17, the heels 30 extend upwardly and above the fold line that extends through slits 28*b*, preventing the flap from disengaging from its locked position. To function properly, the upper edge of the heel, when the roll over flap is in its operative folded position, is spaced below the upper edge of the tabs a distance "F" equal to at least the combined thickness of two panels.

Figure 7:
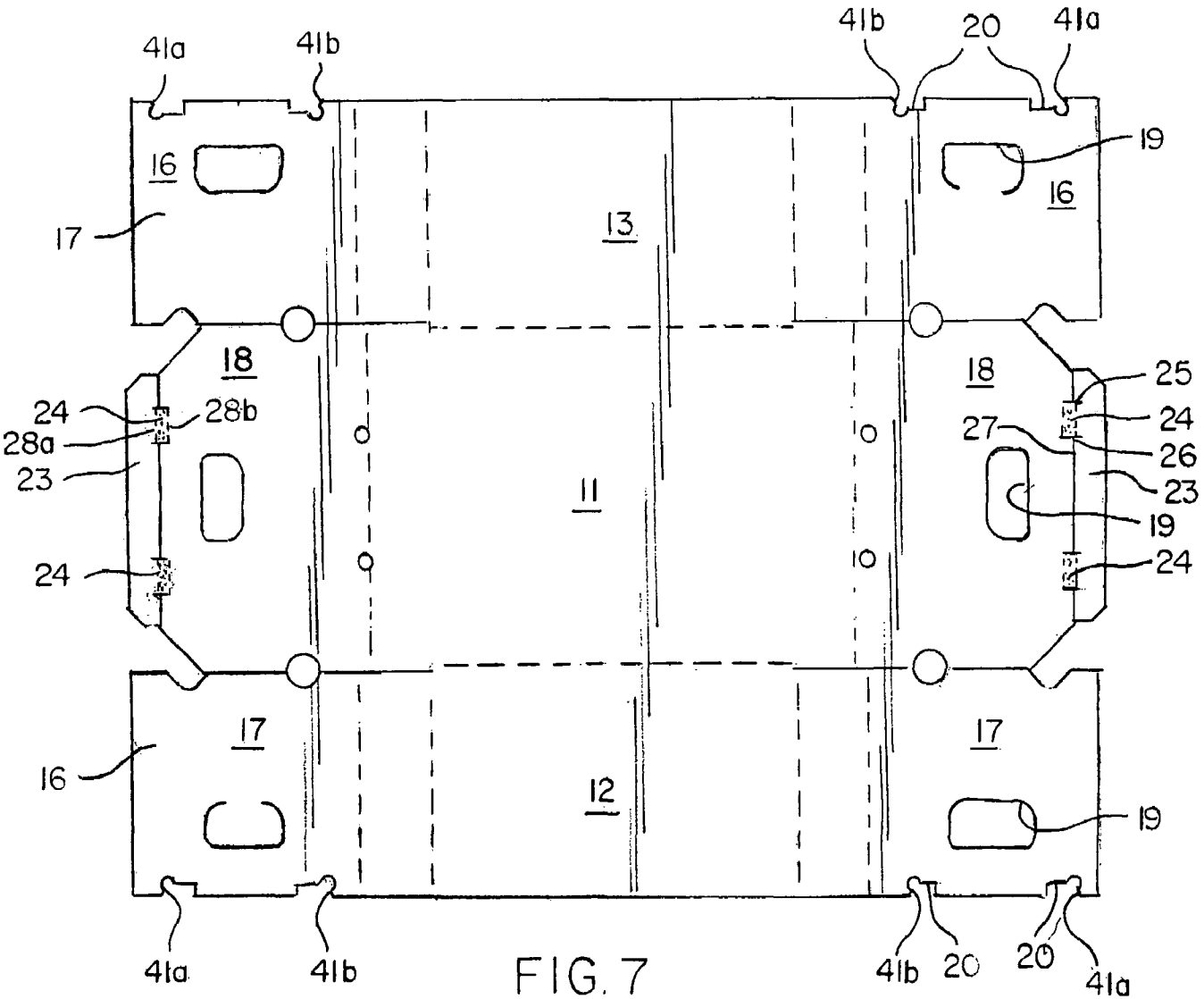
FIG. 7 is a top plan view of a blank for making a first embodiment of the container of the invention, wherein the container has eight sides and incorporates a double hook arrangement for engaging the edges of the roll-over panels to retain them in position, and wherein the hooks in each pair of hooks point toward one another.
Figure 8:
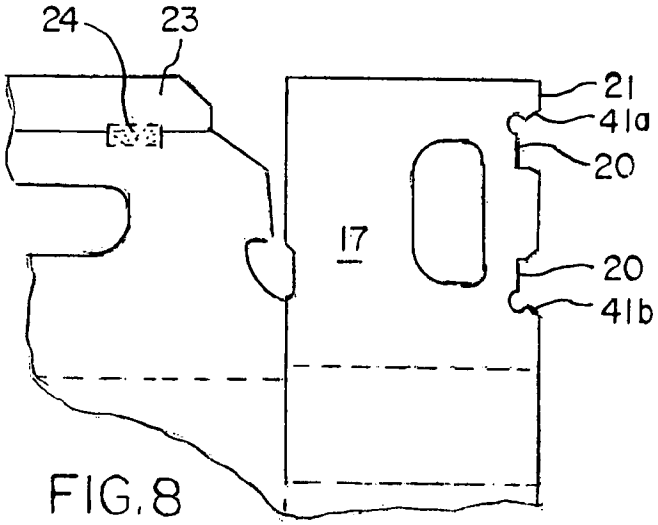
FIG. 8 is an enlarged fragmentary top plan view of one corner of a blank incorporating the improved locking feature depicted in FIG. 7, and showing a slightly modified bag cuff grab means.
Figure 9:
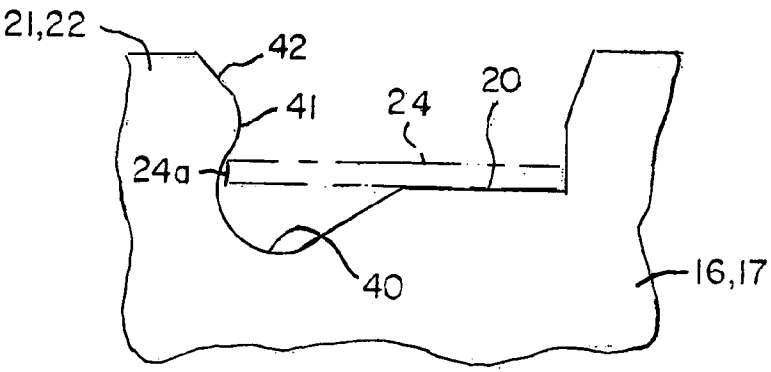
FIG. 9 is a further enlarged, fragmentary plan view of the hook embodying the improved locking feature of the present invention.

The improvement of the present invention is incorporated in the foregoing structure, as depicted in FIGS. 5–12, 15 and 16. With particular reference to FIG. 9, the improvement comprises a shaped cut 40 in one side edge of at least one of the tabs 21 and 22 on at least one of the end flaps 16 and 17, forming an undercut nose or hook 41 at one side of the notch 20. It will be noted that the cut 40 also extends into the bottom of the notch 20. The hooks 41 on each end flap are pointed toward the side wall connected with that end flap. Thus, when the roll-over flap 23 is folded inwardly and downwardly over the in-turned end flaps 16 and 17 and the associated end panel 18, and the roll-over panels or webs 24 (shown in broken lines in FIG. 9) are pulled down into the notches 20, one edge 24*a* of at least one of the roll-over panels is engaged beneath the hook 41. Since the hook points toward the side wall to which the associated end flap is joined, any outwardly directed force on the side wall will tend to pull the associated end flap and hook toward the roll-over panel or web 24, tightening the engagement of the edge of the web beneath the hook, and securing the web against displacement from the notch, thereby preventing release of the roll-over flap 23. It will be noted that the hook 41 is rounded, having a tapered lead-in 42 that facilitates movement of the edge of the web past the hook.

Figure 6:
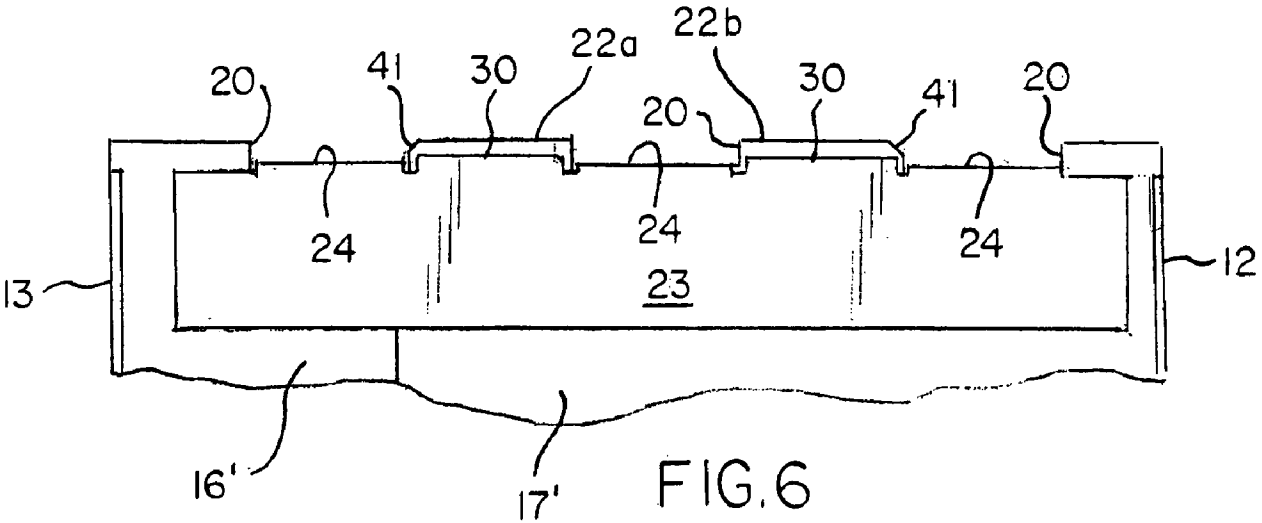
FIG. 6 is an enlarged fragmentary inside end view of the container of FIG. 5, showing in greater detail the improved locking features of the self-locking roll-over flap.
Figure 11:
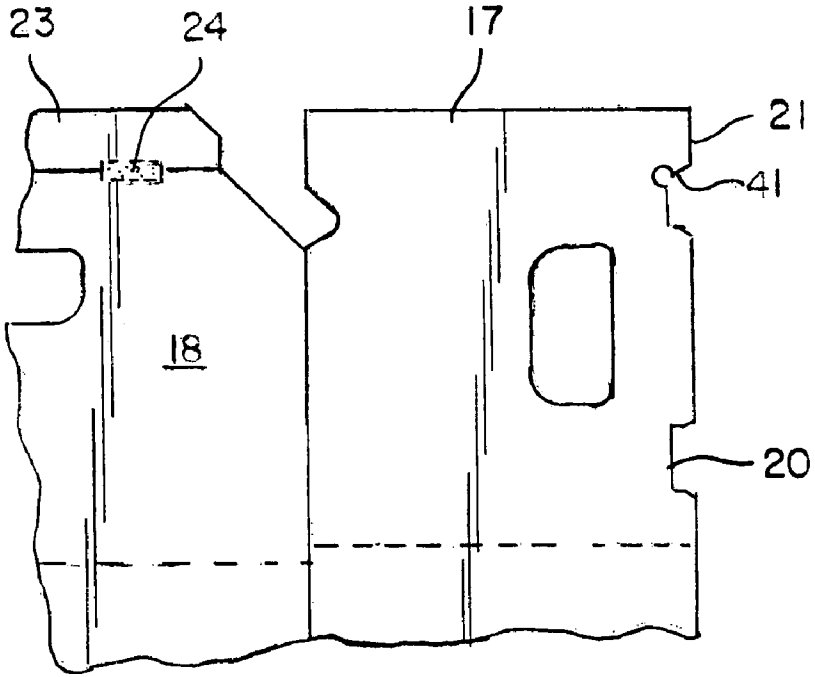
FIG. 11 is a view similar to FIG. 10 of a third embodiment, wherein the hook is located adjacent the end of the end flap that is remote from the associated sidewall panel of the container.

In the embodiment depicted in FIGS. 5 and 6, the end flaps 16' and 17' do not extend all the way across the width of the end wall 15, and each flap has a hook 41 formed on the tabs 22*a* and 22*b*, respectively, adjacent the associated side wall, with the hooks oriented or pointing toward the associated side wall to which the respective end flaps are joined. FIG. 11, for example, shows an arrangement in which only one hook 41 is formed on an end flap, with the hook being formed on the tab 21 at the outer end of the flap. Although only one flap is shown in this figure, it should be understood that an identical structure is duplicated on the flaps at the other side and ends of the container. The other notch 20, at the end of the flap adjacent the associated side wall, is unmodified from that shown in co-pending published application US-2003-0047592-A1.

The difference between the present improvement and the invention disclosed in US-2003-0047592-A1 can clearly be seen by comparing FIGS. 4 and 6.

FIGS. 7 and 8 show a blank and a portion of a blank, respectively, for making one embodiment of a container according to the invention, wherein a pair of oppositely oriented hooks 41*a* and 41*b* are formed at the edges of the notches 20 in the end flaps 16 and 17. With this arrangement, a tighter relationship is achieved between the components of the container as they are being moved into set-up position, but after set-up, only that hook 41*a* pointing toward the side wall to which that end flap is attached will have any appreciable effect in engaging the edge of the web 24 to maintain the roll-over flap in locked position, especially when the container is loaded with product and outwardly directed forces are exerted against the side walls.

Figure 10:
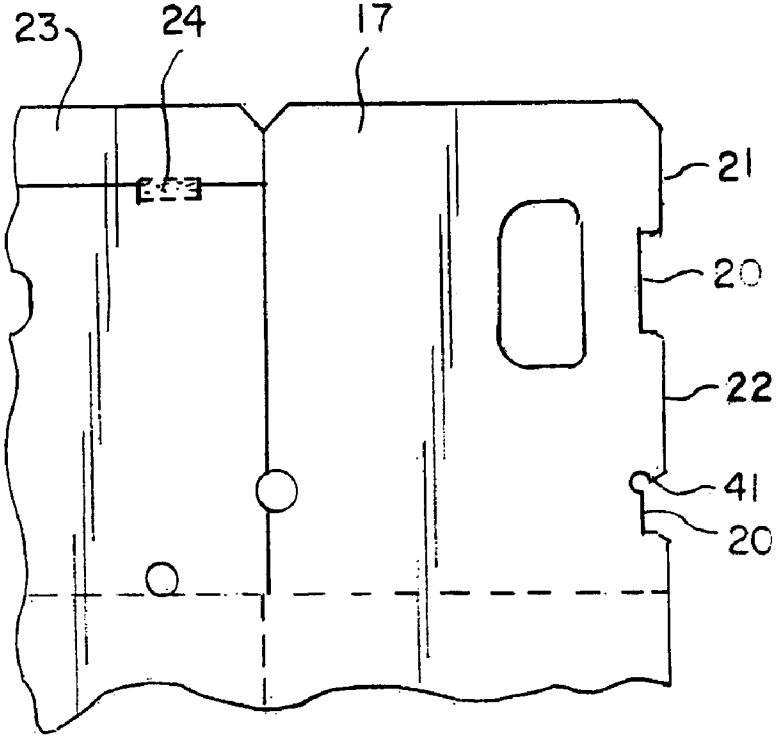
FIG. 10 is an enlarged fragmentary top plan view similar to FIG. 8, showing a second embodiment of the improved locking feature, wherein only a single hook is employed in each end flap, the hook being located adjacent the end of the flap connected to the associated side wall panel of the container.

Another embodiment is shown in FIG. 10, wherein only a single hook 41 is provided on each end flap, with the hook pointing toward the associated side wall, but in this embodiment the hook is formed on the tab 22 adjacent the associated side wall, rather than on the tab 21 at the outer end of the flap 16 or 17 as in the FIG. 11 embodiment.

Figure 12:
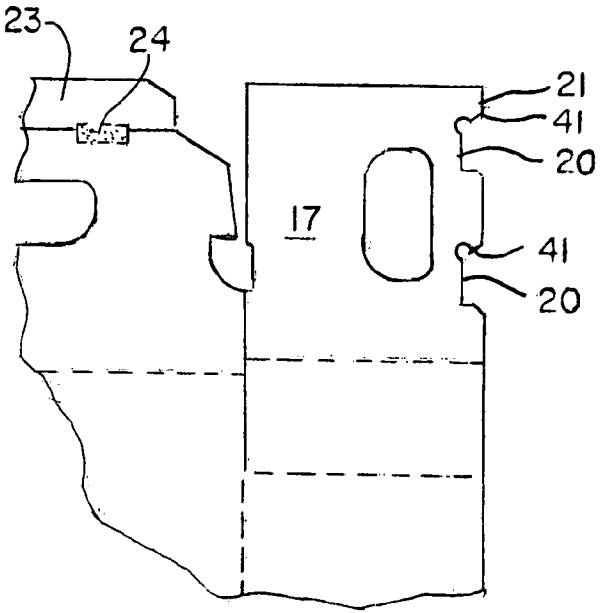
FIG. 12 is a view similar to FIG. 10 of a fourth embodiment, wherein two hooks are employed, but both hooks are oriented to point in the same direction, i.e., away from the associated side wall.

A further embodiment is shown in FIG. 12, wherein a hook 41 is formed in each notch 20, but the hooks are both oriented in the same direction, toward the side wall to which the associated end flap is attached, whereby both of the hooks will engage the edge of a respective web 24 more tightly when the associated side wall has an outward force exerted on it.

Figure 13:
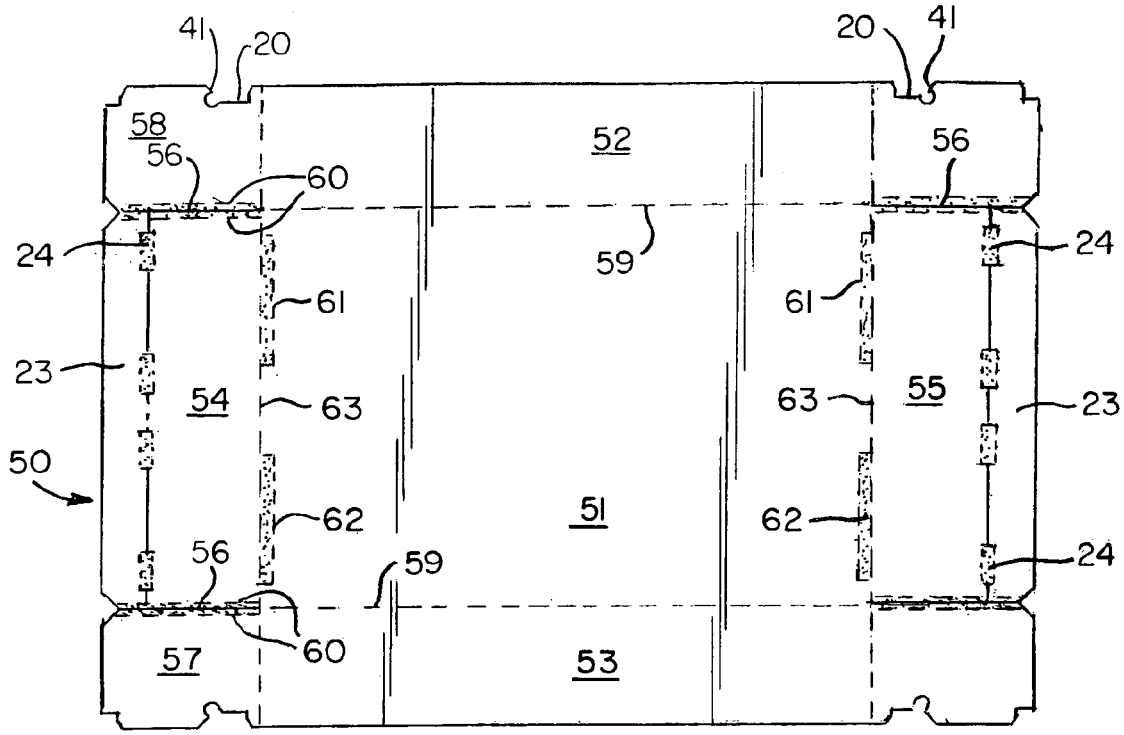
FIG. 13 is a top plan view of a blank for making a first embodiment of a cover incorporating the improved locking feature of the present invention, and also incorporating crushed areas to make space for accommodating the end flaps when they are folded inwardly and captured by the roll-over flap in an erected cover.
Figure 17:
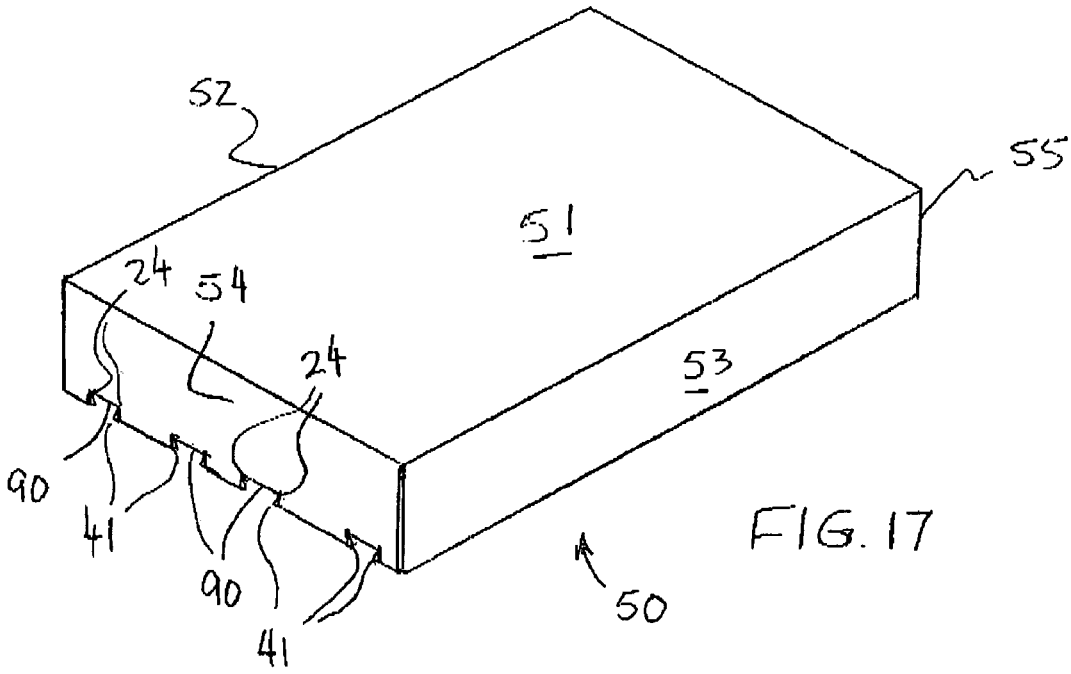
FIG. 17 is a top perspective view of a cover made from the blank of FIG. 13.

A blank for forming a cover 50 incorporating the self-locking roll-over flap and hook of the invention is shown in FIG. 13. The cover includes a central panel 51 that forms the top wall of the cover when it is erected, opposite side wall panels 52 and 53, and opposite end wall panels 54 and 55 each incorporating a roll-over flap 23 as previously described. Slits 56 separate the end wall panels from end flap panels 57 and 58, The slits extend in alignment with the score line 59 that joins the side wall panel to the central top panel, and a narrow portion of the adjacent end flap panel and end wall panel is crushed at 60 on both sides of the slit to relieve some of the pressure created when the tightly fitting components are folded into set-up position. As shown in this embodiment, a single hook 41 is formed in a notch 20 on each end flap panel, for engagement with one of the webs 24 formed in a respective end wall panel 54 and 55, whereby when the cover is erected and the roll-over flap 23 is folded into position, as shown in FIG. 17, notches 90 are formed in the bottom edges of the end walls 54, 56, and the hooks 41 project laterally into the notches, whereby an edge of the web 24 is engaged beneath the hook to securely retain the web and roll-over flap in position. The webs and hooks form interlocking means to hold the parts in erected position. Additionally, crushed areas 61 and 62 are formed in the top panel 51 closely adjacent the score line 63 that joins the end wall panel to the top panel, to form a shallow recess for receiving the end flaps when the cover is in its set-up or erected position. This relief feature is helpful when the slit 56 separating the end flaps from the end wall is in alignment with the score line 59, due to the tight fit of the components in this configuration.

Figure 14:
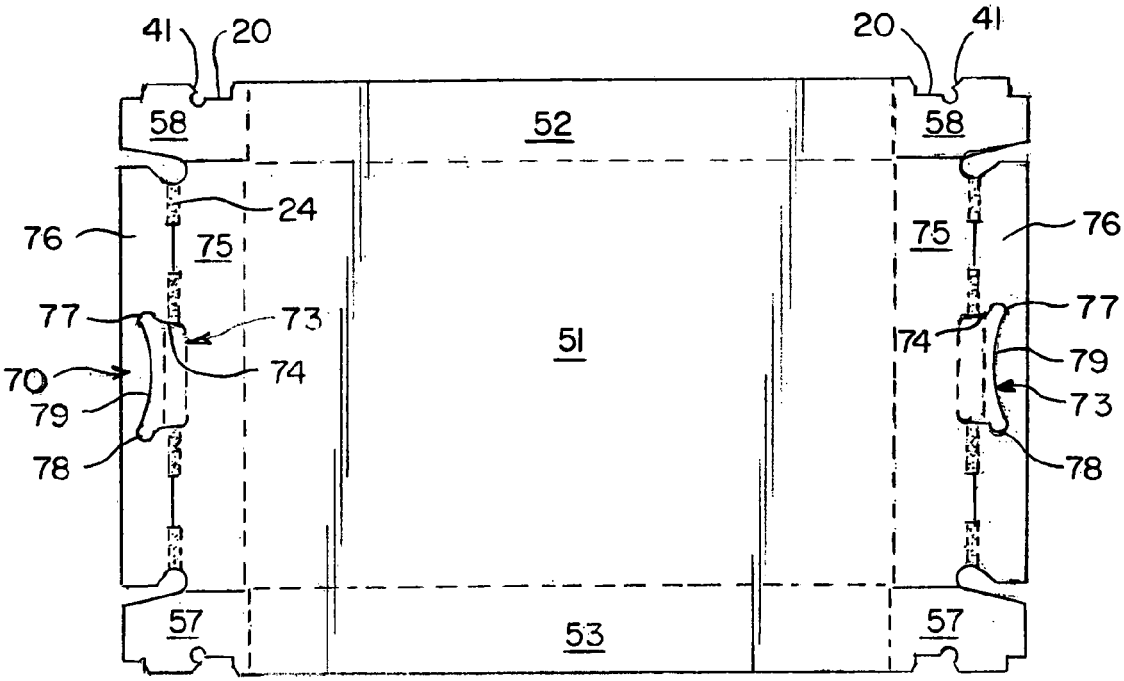
FIG. 14 is a view similar to FIG. 13, showing a blank for making a cover that incorporates the locking feature of the invention, but does not have the crushed areas.
Figure 16:
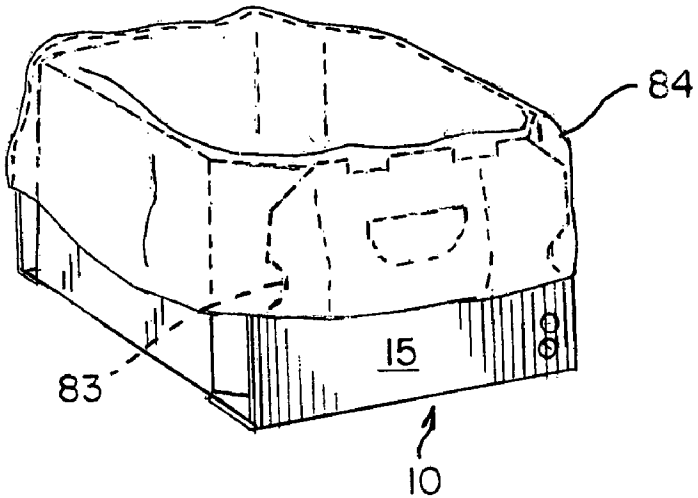
FIG. 16 is a top perspective view of the container of FIG. 15, with the cover removed and showing a bag in place.

Another embodiment of a cover 70 incorporating the hook lock of the invention is shown in FIG. 14. In this embodiment, a single hook 41 is provided on each end flap, as in the previous embodiment, but the slit 71 separating the end flap panel from the adjacent end wall panel is spaced slightly outwardly out of alignment with the score line 72 that joins the side wall panel to the top panel, and the material on opposite sides of the slit is not crushed. However, this embodiment of the cover incorporates a unique cover lock tab 73 for securing the cover to a container 10. The cover lock tab is in the end walls of the cover, and is formed by a shaped cut 74 extending from the end wall panel 75 into the adjoining roll-over flap 76, whereby when the end wall panel and roll-over flap are folded into operative position the tab projects from the edge of panel 75 generally coplanar therewith. The shaped cut defines a pair of outwardly and downwardly projecting wings 77 and 78 on the lower end of the tab, which has an arcuate concave shape 79 extending between the wings. When the cover is placed on a container, the tab projects downwardly from the lower edge of the cover end wall into proximity with the hand holds in the container end wall, and can be easily inserted into the hand holds by pressing the tab inwardly. The wings then spring outwardly, engaging against the container end wall behind the handholds and retaining the cover in place. The arcuate concave shape 79 on the end of the tab facilitates insertion of a finger or fingers behind the end of the tab to pull it back out through the handhold when it is desired to unlock the tab for removal of the cover from the container.

Figure 15:
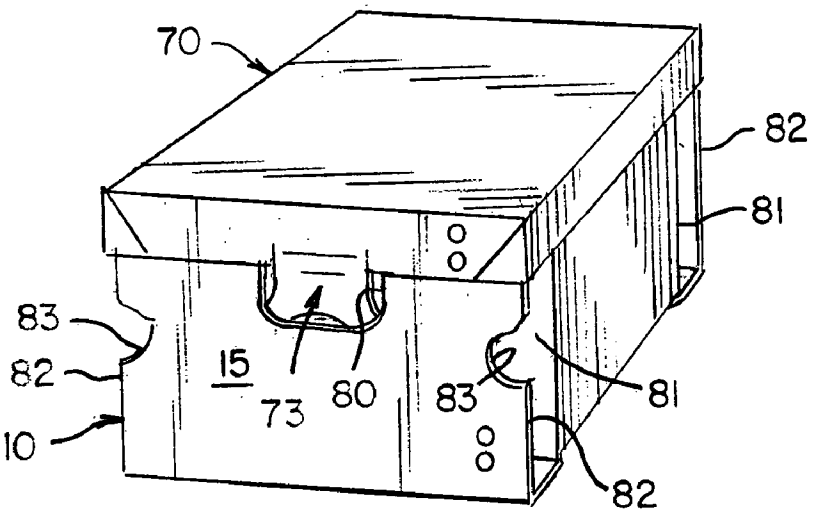
FIG. 15 is a top perspective view of an eight-sided container having a cover made from the black of FIG. 14, wherein the container has bag cuff grab means.

FIG. 15 illustrates a cover 70 with the cover lock tab 73 in position on a container 10 and the lock tab inserted through the handhold 80. It should be noted that when a person inserts their hand in the opening to lift the container, the lock tab folds inwardly out of the way, but springs back when the hand is removed from the opening so the lock tab can be released when desired. The container shown has diagonal corner panels 81 at least at two of the corners, and the end walls 15 extend at their opposite edges 82 beyond the diagonal corner panels, terminating in line with the adjacent side wall. Shaped recesses 83 are formed in the extended edges of the end wall, forming bag cuff grab means for holding the rolled over top of a bag 84 placed in the container. See FIG. 16.

Although particular embodiments of the invention are illustrated and described in detail herein, it is to be understood that various changes and modifications may be made to the invention without departing from the spirit and intent of the invention as defined by the scope of the appended claims.

What is claimed is:

1. A paperboard container, wherein the container has a bottom wall, opposite side walls, opposite end walls, and a self-locking arrangement on the end walls for holding the container in an erected condition, wherein:

said opposite side walls each have opposite ends and a free upper edge, and an end flap panel on each of said opposite ends, said end flap panels each having a free upper edge substantially coplanar with the free upper edge of a respective said side wall, and at least one notch formed in the free upper edge of each said end flap panel;

an end wall panel is on each of opposite ends of the bottom wall, said end wall panel and said end flap panels at respective opposite ends of the container folded into overlapping relationship with one another and forming the opposite end walls of the container;

a roll-over flap is foldably joined by at least one web to said upper edge of each of the end wall panels, said roll-over flap being folded inwardly and downwardly over the free upper edges of the respective end flap panels at opposite ends of the container, said at least one web on the upper edge of each said end wall panel having a width less than the width of an associated said end wall panel, and said at least one web on each of the end wall panels being engaged in said at least one notch in the free upper edge of an associated said end flap panel;

a projection is on the upper edge of each said end flap panel, extending in a direction toward an adjacent said side wall to which an associated said end flap panel is connected and laterally into a respective said notch and forming a hook which engages an edge of an adjacent said at least one web to retain the webs in position in the respective notches and thereby retain the roll-over flaps in inwardly and downwardly folded position, there are a plurality of notches in the upper edge of each said end flap panel; and a said projection is in only one of said plurality of notches.

2. A container as claimed in claim 1, wherein:

the notches include an outermost notch at an outer end of the upper edge of the end flap panel, remote from the end of the end flap panel that is connected to an associated said side wall, and the projection is in said outermost notch.

3. A container as claimed in claim 1, wherein:

the notches include an innermost notch at an inner end of the upper edge of each said end flap panel, adjacent the end of the end flap panel that is connected to an associated said side wall, and the projection is in said innermost notch.

4. A blank for making a container having a bottom wall, opposite side walls, and opposite end walls, comprising:

a central bottom wall panel for forming said bottom wall of said container, said bottom wall panel having opposite side edges and opposite end edges;

a side wall panel foldably connected to each of the opposite side edges of the bottom wall panel for forming said opposite side walls of said container, said side wall panels each having opposite end edges and a free outer edge;

an end flap panel foldably connected to each of the opposite end edges of the side wall panels, said end flap panels each having a side edge which forms an upper edge of each end flap panel in said container, and at least one notch in each said side edge;

an end wall panel foldably connected to each of said opposite end edges of the bottom wall panel;

a roll-over flap foldably connected by at least one web to an edge of each end wall panel opposite the foldable connection of each said end wall panel with the bottom wall panel, each said web adapted to lie in a respective said notch in said container; and a projection on said side edge of each said end flap panel, extending into an associated said notch to form a hook under which an edge of an associated said web engages in said container erected from said; wherein there are a plurality of notches in each said side edge, and a projection is in each of two of said notches that are oriented in the same direction.

5. A cover for a container, wherein said cover comprises:

a top wall, opposite side walls, and opposite end walls;

said end walls each including an end wall panel foldably connected along a respective score line to an adjacent end of the top wall, and end flap panels foldably connected to adjacent ends of the side walls, said end flap panels each having a lower edge with at least one notch therein, and said end wall panels and said end flap panels at each end of the cover being folded into overlapping relationship with one another to form the opposite end walls;

interlocking means on the end walls to hold the cover in erected condition, said interlocking means each including a roll-over flap foldably connected by at least one web to a lower edge of a respective said end wall panel and folded inwardly and upwardly along an inside surface of an associated said end wall panel, with each said at least one web lying in a respective said at least one notch; and relief means for accommodating an upper edge of each end flap panel, said relief means comprising a crushed area in end edge portions of the top wall adjacent said score lines, into which the upper edge of respective said end flap panels can rest to relieve pressure on the panels and avoid bowing of the cover walls.

6. A cover for a container having a bottom wall, opposite side walls, and opposite end walls, wherein openings are in the container end walls defining handholds, said cover comprising:

a top wall, opposite side walls, and opposite end walls;

said cover end walls each including an end wall panel foldably connected at a score line to an adjacent end of the cover top wall, and end flap panels foldably connected to adjacent ends of the cover side walls, said end flap panels each having a lower edge with at least one notch therein, and said end wall panel and said end flap panels at each end of the cover being folded into overlapping relationship with one another to form the opposite end walls;

interlocking means on each of the opposite end walls to hold the cover in erected condition, said interlocking means each including a roll-over flap foldably connected by at least one web to a lower edge of a respective said end wall panel and folded inwardly and upwardly along an inside surface of a respective said end wall panel, with each said at least one web lying in a respective said at least one notch; and a cover lock tab formed on each end wall for engagement in hand hold openings in associated said end walls of said container on which said cover is adapted to be placed, to retain the cover on the container, each said lock tab being defined by a cut made in a respective said cover end wail panel and said associated roll-over flap, forming a tab on each end wall that projects downwardly from the lower edge of each end wall, and each tab a convex, arcuately shaped lower end edge with a pair of outwardly and downwardly directed wings at opposite sides of the convex lower end, said wings flexing to enable each tab to be pushed through a respective said band hold opening and then springing out to retain the lower end of each tab in the opening, and said convex, arcuately shaped lower end edge of each tab providing access for engagement of a finger or fingers beneath the lower end edge to enable the tabs to be withdrawn from a respective hand hold opening.

7. A blank for forming a cover having a top wall, opposite side walls, and opposite end walls, said blank comprising:

a top wall panel that forms the cover top wall in said cover, said top wall panel having opposite side edges and opposite end edges;

a side wall panel foldably connected to each side edge of the top wall panel, said side wall panels having opposite end edges and a free outer edge;

an end wall panel foldably connected to each said end edge of the top wall panel;

an end flap panel foldably connected to each said end edge of each side wall panel, said end flap panels each having an edge that is a bottom edge in said cover, said end wall panel and said end flap panels at each end of the cover being foldable into overlying relationship with one another to form the opposite end walls of the cover;

interlocking means on the end wall panels and end flap panels to hold the cover in erected condition, said interlocking means including at least one notch in said bottom edge of each said end flap panel, and a roll-over flap foldably connected by at least one web to an edge of each end wall panel that is a bottom edge in an erected cover, each said at least one web lying in an associated said at least one when the panels are folded into erected condition with each said roll-over flap folded inwardly and upwardly along an inside surface of a respective said end wall panel; and a cover lock tab formed in each said end wall panel and associated roll-over flap, each said cover lock tab having a free end that is a bottom end projecting below a respective said end wall in said cover, each said bottom end having an arcuate concave edge and outwardly and downwardly angled wings or protrusions at opposite sides of the arcuate concave edge, and being defined by a shaped cut made in an associated said end wall panel and said roll-over flap.

* * * * *